United States Patent [19]

Tritton et al.

[11] Patent Number: 4,527,308

[45] Date of Patent: Jul. 9, 1985

[54] SHIELD

[75] Inventors: Victor R. Tritton; Gary E. Tritton, both of Pointe Claire; Francis Chevillard, St. Francois, all of Canada

[73] Assignee: Les Entreprises Tritton Ltee, Montreal, Canada

[21] Appl. No.: 542,599

[22] Filed: Oct. 17, 1983

[30] Foreign Application Priority Data

Oct. 27, 1982 [CA] Canada ..... 414258

[51] Int. Cl.[3] ..... B65D 77/10

[52] U.S. Cl. ..... 24/30.5 R; 24/30.5 W; 24/115 A; 24/115 M; 292/308; 411/457

[58] Field of Search ..... 24/30.5 R, 30.5 W, 115 A, 24/115 M, 129 W, 535, 537, 542; 292/308; 411/457

[56] References Cited

U.S. PATENT DOCUMENTS

| | | | |
|---|---|---|---|
| 296,329 | 4/1884 | Gibbons | 24/115 M |
| 1,006,241 | 10/1911 | Lippert | 24/30.5 R |
| 1,283,438 | 10/1918 | Boomer | 24/115 A |
| 1,821,418 | 9/1931 | Brooks | 24/115 A |
| 2,163,660 | 6/1939 | Brooks . | |
| 2,181,353 | 11/1939 | Wenk . | |
| 2,358,490 | 9/1944 | Uribe | 411/457 |
| 2,578,504 | 12/1951 | Canter . | |
| 2,619,696 | 12/1952 | Scott . | |
| 2,654,624 | 10/1953 | Canter et al. . | |
| 2,669,476 | 2/1954 | Brooks | 292/308 |
| 2,772,909 | 12/1956 | Moberg | 292/308 |
| 2,983,539 | 5/1961 | Norin | 292/308 |
| 3,371,949 | 3/1968 | Brooks et al. | 292/308 |
| 3,867,944 | 2/1975 | Samuels | 24/30.5 R |
| 4,200,962 | 5/1980 | Niedecker . | |
| 4,223,424 | 9/1980 | Burnett . | |
| 4,308,641 | 1/1982 | Niedecker . | |

FOREIGN PATENT DOCUMENTS

| | | |
|---|---|---|
| 538002 | 3/1957 | Canada . |
| 540494 | 5/1957 | Canada . |
| 546815 | 10/1957 | Canada . |
| 576805 | 6/1959 | Canada . |
| 924686 | 4/1973 | Canada . |
| 1002735 | 1/1977 | Canada . |

*Primary Examiner*—Victor N. Sakran

*Attorney, Agent, or Firm*—Russell, Georges, Breneman, Hellwege & Yee

[57] ABSTRACT

This invention provides a device for closing a flexible container which comprises a body portion having first and second opposed gripping arms extending therefrom. The arms are each adapted to be folded about a fold line relative to the body portion so that the arms, with the body, are capable of at least partially encircling the flexible container for closure thereof. Each of the arms has at least one gripping and engaging means extending inwardly therefrom, and the body has a first gripping and engaging means adapted to fixedly engage the flexible container in one direction and a second gripping and engaging means adapted to fixedly engage the flexible container in a second opposed direction. Means are provided in at least one of the body or arm members for passage of a tie member operatively associated therewith. The device provides a tamperproof closure for a flexible container when used in combination with a tie and deformable sealing element.

11 Claims, 3 Drawing Figures

SHIELD

The present invention relates to a shield for closure of flexible containers. More particularly, the invention provides a shield for use in locking flexible bags against unauthorized tampering.

Prior closures for flexible bags, e.g., money bags, include the use of a lead sealing member through which a tie or cord is threaded and looped around the neck of the bag. The sealing member was then deformed or crimped to grip the tie member therein and seal the bag.

However, several disadvantages occur with the use of such a closure. One such disadvantage is that tampering with the closure was relatively easy so that unauthorized tampering with the contents of the bag frequently occurred. Since the tie or cord encircling the bag could easily be turned, causing a gradual loosening of the cord, the cord and seal could be removed from the bag thus allowing an unauthorized person to tamper with the contents of the bag as a relatively simple matter, after which the cord and seal could then be replaced around the neck of the bag and tightened again, leaving no evidence of any tampering.

With this invention, applicant has overcome the above and other disadvantages associated with prior bag closures. The novel arrangement of the closure of the present invention provides a uniform even anchoring of the closure around the bag and at the same time, prevents anyone from tampering with the contents of the bag.

In accordance with this invention, there is provided shield means for closing a flexible container comprising a body portion having first and second opposed gripping arms extending therefrom, the first and second gripping arms each being adapted to be folded about a fold line relative to the body portion, whereby the arms, with the body, are capable of at least partially encircling the flexible container for closure thereof; each of the arms have at least one gripping and engaging means extending inwardly therefrom and the body has a first gripping and engaging means adapted to fixedly engage the flexible container in one direction; the body further has a second gripping and engaging means adapted to fixedly engage the flexible container in a second opposed direction, and means are provided in at least one of said body or arm members for passage of a tie member operatively associated therewith.

The gripping and engaging means associated with the body of the shield preferably are in the form of angled teeth positioned on opposite sides of the body with the apex of each tooth directed in opposite directions so that turning of the shield in either direction, once it is looped around a flexible container with an associated tie member, would only result in the teeth embedding themselves in the flexible container.

As will be appreciated, with the novel right-left positioning of the gripping teeth on the body of the closure-that is, the positioning of the apex of each tooth in opposing directions, a more even anchoring or holding of the bag is achieved, while at the same time, such right-left arrangement prevents any undesired intruders tampering with the closure. Thus, by virtue of the right-left arrangement, any attempt to turn the shield to try to loosen the tie member associated therewith would only result in the teeth of the shield becoming embedded in the flexible container or bag. It will be noted that turning of the shield in either direction, by virtue of the positioning of the teeth has the same effect—i.e., turning in the clockwise direction would cause the tooth facing left to grip the bag, while counter-clockwise turning would produce a similar effect with the right tooth.

The gripping and engaging means provided on the arms of the shield of this invention may be in the form of triangular-shaped teeth and any number of such teeth could be provided on the arms. In a preferred form, the arms are each provided with two sets of teeth, one set adjacent the fold line between the body and arms. Each tooth is directly inwardly of the arms, one being provided on either side of the arm. The second set of teeth, in a preferred aspect, is provided at the ends of the arms remote from the fold line. Again, such teeth are directly inwardly and are provided on each side of the arms.

It will be appreciated that it is not essential that two sets of teeth, as discussed above, be provided, however, a better gripping and engaging action is attained with the two sets of teeth.

The shield of this invention is provided with at least one aperture on each of the arms, and preferably in the body so that a tie member can be threaded through the shield. The tie is then placed around the neck of a bag and funneled through a typical sealing element. The sealing element is then deformed in a conventional manner, gripping the tie and sealing the bag against undesired intrusions.

In a preferred form, each arm is provided with two apertures separated by a shoulder or upraised portion of the arm. The provision of such a shoulder permits more easy handling of the tie member to be threaded through the apertures and underneath the shoulders in that when it is desired to tighten the tie member around the neck of a bag, the tie is more free to be pulled tight by virtue of the shoulder. In a like manner, each arm, at its end remote from the body, may, if desired, be provided with a reverse shoulder or slightly recessed channel, again, to aid in the passage and tightening of the tie member.

As mentioned above, the body of the shield may also be provided with an aperture for the passage of the tie member, however, more than one aperture could be provided in the body, or only the arms need be provided with apertures. The provision of the apertures in the shield are for the passage of a tie member to be associated with the shield and thus need not conform to the specific embodiments disclosed herein.

The shield of the present invention is preferably used in conjunction with a conventional tie member or cord as discussed above, as well as with a deformable sealing member such as is well known to those skilled in the art. Such deformable sealing member serves to seal and grip the tie member therein upon deformation thereof, as will be discussed in greater detail hereinafter.

The tie member or cord may, as stated, be any conventional tie member such as of a fibrous rope-like nature. The only requirement of the tie member is that it can be wrapped around the neck of a bag and threaded through the shield and sealing element.

In the same vein, any suitable sealing element can be used. A conventional sealing element is made of lead and is provided with channels therethrough for the passage of the associated tie member or cord. Upon deformation of the sealing element, the tie is thereby gripped within the sealing element.

The shield, tie and sealing element are adapted to "lock" a flexible container against undesired entry. As such, any flexible container can be used in association with the closure of this invention, e.g., bags of plastic or canvas material, etc.

It will be appreciated that the shield of the present invention may be made of any suitable material such as relatively thin steel. The material should be relatively flexible so as to be bent or collapsed around a bag. Likewise, the dimensions of the shield will be merely a matter of the desired end use. Thus, if the total neck of the bag is to be surrounded or encircled by the shield, a larger shield would be required than if the shield is to only partially surround the neck of a bag.

As will also be appreciated, the shield can be made of a one-piece integral construction, or alternatively, could be made in component parts and then assembled, e.g., by welding. The apertures associated with the shield for the passage of the tie member may be provided in the shield in any conventional manner, for example, by punching, drilling, etc.

Having thus generally described the invention, reference will now be made to the accompanying drawings illustrating preferrcd embodiments of the invention, and in which.

Figure 1:
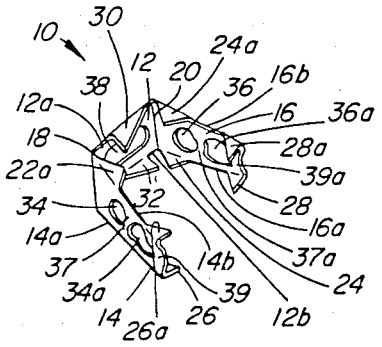
FIG. 1 is a perspective view of the shield of the present invention.

Referring now to the drawings in greater detail, the shield of the present invention can be seen in FIG. 1 indicated generally by reference numeral 10. In the embodiment shown in FIG. 1, shield 10 comprises a body or base 12 having opposed sides 12*a* and 12*b*. Body 12 has two opposed gripping arms 14 and 16 extending therefrom which in the FIG. 1 position, extend at approximately right angles from body 12 along fold lines 18 and 20. Shield 10 is dimensioned to at least partially encircle the neck of a flexible container as will be discussed in greater detail hereinafter.

Arms 14 and 16 are generally rectangular in shape and have opposed sides 14*a*, 14*b* and 16*a*, 16*b*. Arms 14 and 16 terminate adjacent body 12 at fold lines 18 and 20; as will be seen from FIG. 1, arm 16 is provided with triangular projections or gripping teeth 24, 24*a* extending inwardly at right angles from the arm, adjacent the fold line 20 of arm 16. Arm 14 is provided with similar teeth (only one of which can be seen in FIG. 1 at 22*a*). These teeth are each provided on opposite sides 14*a*, 14*b* of arm 14 as are teeth 24 and 24*a* provided on opposite sides 16*a*, 16*b* of arm 16. The gripping teeth are provided for the gripping engagement of the shield with a flexible container or bag.

Further teeth 26, 26*a* and 28, 28*a* may also be provided on arms 14 and 16 at their ends remote from body 12 for the purpose of ensuring the complete anchoring of the shield around the neck of a flexible container. As with teeth 22*a* and 24, 24*a*, teeth 26 and 26*a* are positioned on opposite sides 14*a*, 14*b* of arm 14 and teeth 28, 28*a* are positioned on opposed sides 16, 16*a* of arm 16.

Body 12, as will be evident from FIG. 1, also includes angled projections or teeth 30 and 32 positioned in opposed relationship to each other. Teeth 30 and 32 are provided on opposed sides 12*a* and 12*b* of body 12 and extend inwardly at right angles from body 12. The novel right-left arrangement of the angled teeth 30 and 32 provides a tamperproof closure for a flexible container.

Thus, it will be noted that teeth 30 and 32 are positioned in opposed relationship to one another. That is, projection 30 has its apex directed to the left of FIG. 1, while projection 32 is positioned in the opposite manner—with its apex to the right of FIG. 1.

This arrangement of the teeth 30 and 32 provides a shield which eliminates tampering and/or removal of the closure from a flexible container, since turning of the shield in either direction would result in either one or the other of the teeth 30, 32 embedding in the flexible container.

The arrangement of these gripping teeth as well as the teeth provided on the arms 14 and 16 also provide for an overall even anchoring or holding of the flexible container and prevents slippage of the shield around the flexible container.

FIG. 1 also illustrates means for receiving a tie member provided in the shield 10. As shown in FIG. 1, such means may comprise one or more apertures 34, 34*a* and 36, 36*a* provided in the arms 14, 16. Body 12 is also provided with an elongated aperture 38 for the passage therethrough of a tie member as will be discussed in greater detail hereinafter.

Arm 14 is also provided with shoulder 37 separating the apertures 34 and 34*a*. Shoulder 37 comprises a slightly upraised portion of the arm 14 which permits more easy passage of a tie member to be associated therewith. In addition, arm 14 can be seen from FIG. 1, to include a reverse shoulder 39 which comprises a slightly recessed channel in the arm 14. The provision of reverse shoulder 39 also allows for more easy channeling of a tie member through the shield 10.

Opposed arm 16 is also provided with a shoulder 37*a* and reverse shoulder 39*a* for the same purpose.

Figure 2:
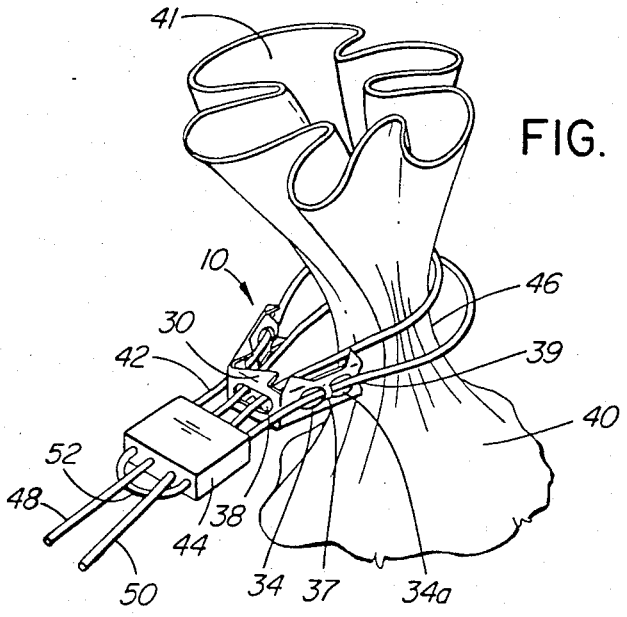
FIG. 2 is a perspective view of the shield of the present invention shown in use on a flexible bag and including an associated sealing element and tie member.

Referring now to FIG. 2, the shield 10 of the present invention is illustrated in its application to a flexible container or bag 40 having an open mouth 41. In use, the shield 10 is used in conjunction with a tie member 42 and a sealing element 44. Seal 44 is provided with channels (not shown) for the funneling of tie member 42 therethrough. Seal 44 is generally of a construction well known to those skilled in the art and accordingly will not be discussed in detail herein since it will be appreciated that other forms of sealing elements could be used in conjunction with this invention, the only requirement being that the element be capable of being deformed or crimped in order to retain a tie member therein.

Tie member 42, again known to those skilled in the art may be any suitable tie member. Tie member 42 is dimensioned to allow for the easy passage thereof through the channels provided in the sealing element 44. The tie member 42 can be of any length sufficient to allow for its encirclement of the neck 46 of the container 40 and its passage through shield 10 and element 44. The ends 48, 50 of the tie member 42 may later be severed, upon deformation of the sealing element 44.

In the embodiment shown in FIG. 2, tie member 42 is looped at 52 through channels (not shown) in seal 44. Each end of the tie member 42 is then threaded through apertures 34, 34*a* and 36, 36*a* under shoulders 37, 37*a* and over reverse shoulders 39, 39*a*. Each end of the tie member 42 is then looped around neck 46 and relayed through aperture 38 in body 12 into and through appropriate channels provided in seal 44.

Figure 3:
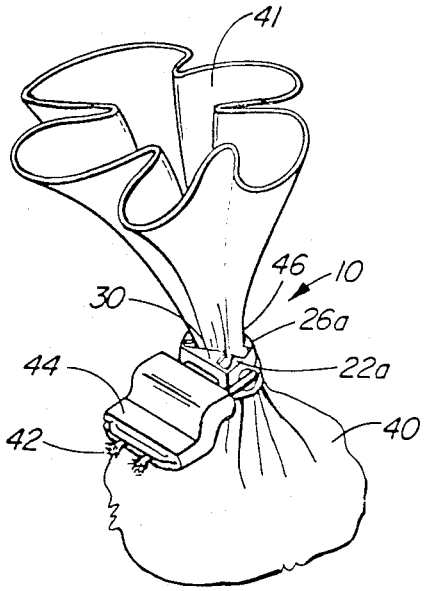
FIG. 3 is a view similar to FIG. 2 showing the shield and closure in its sealed position.

From FIG. 3, it will be seen that shield 10 is brought into gripping engagement with the neck 46 of container 40. In this position, the shield 10, in conjunction with the tie member 42 threaded therethrough, encircles the neck 46 and the tooth 22*a* and the opposite tooth (not shown) together with teeth 24, 24*a*, 26, 26*a* and 28, 28*a* grippingly engage the neck of the bag.

It should be noted that shield 10 need only partially encircle the neck of the bag since tie member 42 provides for the complete encirclement of the neck.

It will also be seen that tooth 30, (as well as opposed tooth 32 not shown in FIG. 3) also engages the flexible bag in a gripping relationship therewith.

The tie member is then tightened around the neck of the bag. As discussed previously, the provision of shoulders 37, 37*a* and 39, 39*a* aid in tightening of the tie member since they allow for the smooth passage of the tie member through the shield 10. Sealing element 44 is then brought into contact with body 12 and with the tie member threaded through the channels of seal 44, deformation of the seal is performed to "lock" the tie member therein, thus effectively sealing the bag against undesired entry.

Deformation of the seal 44 may be accomplished by any suitable means well known to those skilled in the art. As viewed in FIG. 3, deformed seal 44 encloses the tie member therein thus locking the bag against opening.

As will be appreciated, any unauthorized tampering with the shield and seal in the position shown in FIG. 3 is eliminated. As such, it will be seen that turning of the shield 10 in a clockwise direction would cause one of the opposed teeth 30, 32 to embed itself in the bag, and counterclockwise turning of the shield 10 would cause the other of the teeth 30, 32 to embed in the container and accordingly, a closure is provided which is virtually tamper-proof against unwanted persons.

We claim:

1. A device for closing the mouth of a flexible container comprising:

a body portion having first and second gripping arms extending from opposed ends of said body portion, the first and second gripping arms each being adapted to be folded about a fold line relative to said body portion whereby said arms, with said body portion, are capable of at least partially encircling the mouth of said flexible container for closure thereof;

each of said first and second gripping arms having at least one gripping and engaging means extending inwardly therefrom;

said body portion having an upper inwardly extending gripping and engaging means adapted to fixedly engage the flexible container in one direction towards said first gripping arm;

said body portion further having a lower inwardly extending gripping and engaging means spaced from said upper gripping and engaging means adapted to fixedly engage said flexible container in a second opposed direction towards said second gripping arm; and means provided in at least one of said body portion and said gripping arms for passage of a tie member operatively associated therewith; whereby in use, said upper and lower gripping and engaging means on said body portion hinder rotation of said device in any direction around a flexible container.

2. A device as defined in claim 1 wherein said means for the passage of a tie member comprise a pair of apertures in each arm.

3. A device as defined in claim 2 further including an aperture provided in said body portion.

4. A device as defined in claim 2 wherein said apertures are separated by an upraised portion on each gripping arm.

5. A device as defined in claim 4 further including a recessed channel on each gripping arm for receiving a tie member passed through said apertures.

6. A device as defined in claim 1 wherein each gripping arm is provided with two pairs of gripping and engagement means, one pair adjacent said fold line and the other pair at the ends of said gripping arms remote from said fold line.

7. A device as defined in claim 1 wherein said gripping and engaging means are in the form of triangular-shaped teeth.

8. A device as defined in claim 1 wherein said upper gripping and engaging means on said body portion comprises an angular-shaped tooth having its apex pointed in one direction, and said lower gripping and engaging means comprises an angular-shaped tooth having its apex pointed in a second opposed direction.

9. A device as defined in claim 6 in combination with a tie member adapted to be passed through said device and a deformable sealing element having channels therein for the passage of said tie member.

10. A device as defined in claim 6, wherein said one pair of gripping and engagement means adjacent said fold line comprise triangular-shaped teeth, one each being provided on opposed edges of said gripping arms, and said other pair of gripping and engagement means at the remote ends of said gripping arms comprise triangular-shaped teeth, one each being provided on opposed edges of said gripping arms.

11. A device as defined in claim 8 wherein said upper and lower gripping and engaging means are provided on opposed edges of said body portion.

* * * * *